United States Patent [19]

Reed, Jr. et al.

[11] 4,358,327

[45] Nov. 9, 1982

[54] GAS GENERANT PROPELLANTS

[75] Inventors: Russell Reed, Jr.; Benjamin Y. S. Lee, both of Ridgecrest; Ronald A. Henry, China Lake, all of Calif.

[73] Assignee: The United States of America as represented by the Secretary of the Navy, Washington, D.C.

[21] Appl. No.: 196,893

[22] Filed: Oct. 14, 1980

[51] Int. Cl.[3] ..... C06B 15/10

[52] U.S. Cl. ..... 149/19.4; 149/19.6; 149/88; 149/92

[58] Field of Search ..... 149/19.4, 19.6, 92, 149/88

[56] References Cited

U.S. PATENT DOCUMENTS

| | | | |
|---|---|---|---|
| 3,332,353 | 7/1967 | Burkardt et al. | 102/70 |
| 3,375,230 | 3/1968 | Oja et al. | 260/67.6 |
| 3,677,841 | 7/1972 | Ayres et al. | 149/92 |
| 3,909,322 | 9/1975 | Chang et al. | 149/19.4 |
| 4,013,596 | 3/1977 | Einberg | 260/2 R |
| 4,201,853 | 5/1980 | Henry et al. | 149/19.4 |

*Primary Examiner*—Stephen J. Lechert, Jr.
*Attorney, Agent, or Firm*—R. F. Beers; W. T. Skeer

[57] ABSTRACT

A gas generant propellant composition having low flame temperatures comprising (a) an elastomeric binder consisting of a mixture of polyethylene capped polypropylene glycol and a dihydroxy tetrazole selected from the group having the formulas:

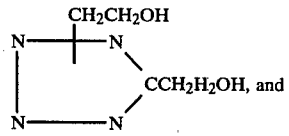

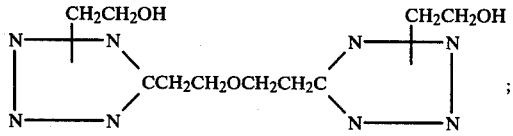

;

(b) a curative agent such as the biuret trimer of hexamethylene diisocyanate; (c) a plasticizer agent such as 1-methyl-5 (methoxyethyl) tetrazole; (d) a coolant agent such as oxamide; and (e) a deflagrating agent selected from the group consisting of: dihydrazinium 3,6-bis(5-tetrazolyl)-1,2-dihydrotetrazine, dinitrosopentamethylenetetramine, the reaction product of glyoxal and hydrazine and the ammonium salt of 5-nitramino tetrazole.

7 Claims, No Drawings

GAS GENERANT PROPELLANTS

BACKGROUND OF THE INVENTION

1. Field of the Invention

This invention relates to gas generant propellant compositions. More particularly, it relates to gas generant propellant compositions which are sufficiently cool to inflate various rubber and plastic devices. Still more particularly, this invention relates to gas generant propellants and a process for their preparation using high nitrogen compounds in which said high nitrogen compounds are used to sustain deflagration wherein a minimum of oxidizer is used and nitrogen is the major gaseous product.

2. Description of the Prior Art

A need exists for gas generant propellants which are sufficiently cool to inflate various rubber and plastic devices. Most gas generant propellants available have flame temperatures above 1800° F. and pyrolyze the organic materials used in the manufacture of such inflatable devices. Thus, most propellants are not suitable for use therewith.

Conventional propellants contain a binder, which acts as a fuel and an oxidizer. Upon oxidation of the binder, deflagration occurs and the heat liberated by the formation of water and carbon dioxide produces relatively high flame temperatures. Attempts have been made to lower deflagration temperatures by limiting the amount of oxidizer used. However, when the oxidizer levels of a conventional oxidizer are reduced to achieve a flame temperature of a calculated acceptable value (in the range of about 1000° F. to about 1200° F.) for use with inflation devices, such propellants will not burn and thus, are of no use in accomplishing the objectives of this invention.

SUMMARY OF THE INVENTION

It is an object of this invention to provide a low deflagration temperature, solid gas generating propellant composition and a process for its preparation.

Another object of the present invention is to provide a solid gas generating propellant composition in which the deflagration of high nitrogen compounds is used to sustain the deflagration and thus yield low flame temperatures (i.e. flame temperatures in the 1000° F. to 1200° F. range).

Still another object of the instant invention is to provide a solid gas generating propellant composition and a process for its preparation in which a minimum of oxidizer is used and nitrogen is the major gaseous product.

DESCRIPTION OF THE PREFERRED EMBODIMENTS

This invention provides a gas generant propellant composition yielding flame temperatures which are sufficiently low so that the composition may be used to inflate various rubber and plastic devices and to a process for its preparation.

The gas generant propellant composition of this invention is prepared using the steps of preparing an uncured binder composition, adding various additives to it and curing the binder composition to a solid. The improvement resides in utilizing as the uncured binder composition a mixture of a polyethylene glycol capped polypropylene glycol and a dihydroxy tetrazole selected from those having the following formulas:

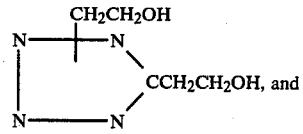

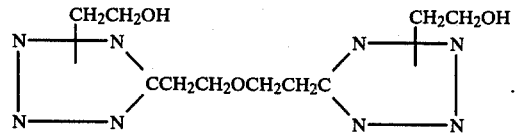

The biuret trimer of hexamethylene diisocyanate is a suitable curative for the binder. A plasticizing agent such as 1-methyl-5-(methoxyethyl)tetrazole and a coolant agent such as oxamide may be used. A deflagrating agent, selected from the group consisting of dihydrazinium 3,6-bis(5-tetrazolyl)-1,2-dihydrotetrazine, dinitrosopentamethylenetetramine, the reaction product of glyoxal and hydrazine or the ammonium salt of 5-nitraminotetrazole is added.

Binders used in this invention, in combination with the coolant and deflagrating additives, yield a gas generant propellant composition having flame temperatures which are sufficiently cool to inflate various rubber and plastic devices.

The following examples are presented to illustrate the invention:

EXAMPLES 1–4

Examples 1 through 4 in the following table illustrate some of the ingredients used in propellants according to the invention and the properties thereof.

| | 1 | 2 | 3 | 4 |
|---|---|---|---|---|
| Ingredients in Wt. % | | | | |
| Bishydroxyethyl tetrazole | 2.58 | 2.06 | 2.58 | 2.58 |
| Polyethylene glycol capped polypropylene glycol | 13.27 | 10.62 | 13.27 | 13.27 |
| Biuret trimer of hexamethylene diisocyanate | 9.15 | 7.32 | 9.15 | 9.15 |
| 1-methyl-5-(methoxyethyl) tetrazole | 25.00 | 20.00 | 25.00 | 25.00 |
| Ammonium salt of 5-nitraminotetrazole | 50.00 | 25.00 | 20.00 | |
| Dihydrazinium 3,6-bis(5-tetrazolyl)-1,2-Dihydrotetrazine | | | | 50.00 |
| Oxamide | 0.00 | 35.00 | 30.00 | |
| Properties | | | | |
| Flame Temp. °K. | | | | |
| chamber | 1794 | 1384 | 1370 | 1642 |
| exhaust | 1002 | 694 | 690 | 904 |
| Burning Rate | | | | |
| 1500 psi | | | | 0.11 |
| 1000 psi | 0.19 | | | |
| 500 psi | | | | 0.06 |
| 400 psi | 0.11 | | | |

Examples 1–4 set forth fairly specific amounts for each ingredient. Amounts in the ranges set forth in Examples 2 and 3 constitute the best mode for practicing the invention known to the inventors at this time (note that the exhaust flame temperature is much cooler with oxamide than without). However, the bishydroxyethyl tetrazole may be varied in the range of weight percentages between 1 and 5. The polyethylene glycol capped polypropylene glycol may be varied in the range of weight percentages between 8 and 16. The curative may be varied in the weight percentage ranges of from 5.51 to 15.06 (for the higher level of tetrazole binder). Other isocyanates were less effective. The plasticizer may be varied in the weight percentage range of from 10 to 30. The deflagrating agent may be varied in the range of from 20 to 60. Oxamide is suitable as a coolant. Other coolants are polyethylene powder, polyformaldehyde and polyethylene glycols having molecular weights over 4000.

The bishydroxyethyl tetrazoles set forth above by means of a formula may be used interchangeably.

The polyethylene glycol capped polypropylene glycol used in this invention is supplied by the Wyandotte Corporation. It is prepared by reacting propylene oxide with the two hydroxyl groups of a propylene glycol nucleus (in the presence of an appropriate catalyst) until chains having a desired molecular weight are built up and then adding ethylene oxide to cap the chains. The particular material used in experiments leading to this invention had an average molecular weight of about 2000.

The ammonium salt of 5-nitraminotetrazole which has been indicated to be a deflagrating agent might be considered by some to be an oxidizer. However, it is such a weak oxidizer that a more proper term for it is deflagrating agent (a deflagrating agent is a material that burns on its own without oxygen from the air). The ammonium salt of 5-nitraminotetrazole may be replaced with like amounts of the deflagrating agents dihydrazinium 3,6-bis(5-tetrazolyl)-1,2-dihydrotetrazine, dinitrosopentamethylenetetramine, and the reaction product of glyoxal and hydrazine.

The ammonium salt 5-nitraminotetrazole is somewhat acidic. When it is used as a deflagrating agent in lieu of one of the others set forth, it is preferable that it be coated. Coating negates the acidic nature of the material and prevents the material from reacting with the isocyanate curative. To coat the material, a small amount of silane is dissolved in methanol and the material is added and stirred in to form a slurry. The slurry is filtered and the solvent is removed from the salt in vacuo to produce a coated material free of surface acidity. A suitable silane is $H_2NCH_2CH_2NHCH_2CH_2CH_2Si(OCH_3)_3$. Enough silane should be used so that if it were figured into or considered to be a separate ingredient in Examples 1–3 it would make up from about 0.2 to about 2 weight percent of the total amount of ingredients used. The other three deflagrating agents need not be coated.

Insofar as is known by the inventors, the two dihydroxy tetrazoles useful in the binder of this invention have not been described in the literature previously. It will be noted that the hydroxyethyl groups attached to nitrogens are not depicted as being attached to any particular nitrogen in the structural formulas given above. This is because, as prepared, mixtures of the 1- and 2-hydroxyethyl compounds are obtained. The following procedures have been used for preparing the dihydroxy tetrazoles.

PROCEDURE 1

1- and 2-(2-Hydroxyethyl)-5-(2-hydroxyethyl)tetrazoles 5-(2-Hydroxyethyl)tetrazole 136.8 g (1.2 moles) and 48 g (1.2 moles) of sodium hydroxide were dissolved in 240 ml of water. 2-Chloroethanol 106.2 g (1.31 moles) was added and the solution was refluxed for 18 hr. After the pH had been readjusted to the phenolphthalein endpoint, the solution was evaporated to dryness. The gummy cake was stirred with 300 ml of absolute ethanol, the pH again adjusted to the phenolphthalein endpoint, 300 ml of acetone and 100 ml of diethyl ether added, and the slurry chilled to −15° C. The solid was removed by filtration and the cake washed with enough cold mixed solvent to just cover. The filtrate and washings were diluted with 450 ml of ether and chilled further at −15° C. More solid separated and was removed; concentrating of the filtrate on a rotary evaporator at pump limit left 188 g of viscous oil. The final evaporation was done at about 90° C. in order to remove excess 2-chloroethanol, water and any ethylene glycol derived from the former compound. This dry, crude material was dissolved in 900 ml of acetone, treated with 500 ml of ether and chilled at −15° C. for several days. The supernatant was decanted from a dark, viscous layer and evaporated to leave 137.6 g (72.5%) of very pale yellow oil. The pH of an aqueous solution was 8–8.5; a small amount of precipitate formed when a few drops of silver nitrate solution was added. Since much, but not all, of the precipitate dissolved in nitric acid, some unalkylated tetrazole is indicated as well as sodium chloride. Based on the $^1H$ nmr spectrum, the product contains about 74% of the 2-isomer and 26% of the 1-isomer.

Anal: Calcd. for $C_5H_{10}N_4O_2$: N, 35.43. Found: N, 33.55.

If desired, the unalkylated tetrazole and halide can be removed by first stirring such a product in absolute methanol for several days with a large excess of an anionic exchange resin (basic form), filtering and evaporating, followed by stirring in absolute ethanol plus diethyl ether with finely powdered sodium dihydrogen phosphate to remove base, filtering and reevaporating. An aqueous solution of the resulting product is neutral and only a faint turbidity with silver ion is produced.

Anal: Found: N, 34.92.

PROCEDURE 2

Bis-[2-(5-tetrazolyl)ethyl]ether

Bis-(2-cyanoethyl)ether 186 g (1.5 mole), 215 g of sodium azide and 177 g of ammonium chloride were slurried in 1070 ml of dimethylformamide. The mixture was heated at 118°–122° C. with stirring and under reflux for 24 hr. (since ammonia and some ammonium azide are evolved, the heating should be done in a hood). After the bulk of the solvent had been removed at 80°–90° C. and 25 mm pressure, the residue was first heated to boiling with 500 ml of water and 40 ml of concentrated hydrochloric acid, then cooled to 5° C. (Caution: some hydrazoic acid is liberated). The product was filtered, washed twice with cold water and dried; 287 g (91%). Recrystallization of 5 g from 85 ml of water furnished coarse blades, m.p. 199°–200° C. (dec.).

Anal: Calcd. for $C_6H_{10}N_8O$: C, 34.28; H, 4.80; N, 53.31. Found: C, 34.18; H, 4.90; N, 53.40.

PROCEDURE 3

Bis-{2-[1- and 2-(2-Hydroxyethyl)-5-tetrazolyl]ethyl} Ether

Bis[2-(5-tetrazolyl)ethyl] ether (180 g) was dissolved in 750 ml of water plus 68.5 g of sodium hydroxide. 2-Chloroethanol 164 g (20% excess) was added and the solution was refluxed for 23 hr. Occasionally during the heating and again at the end of the reflux period the pH was readjusted to the phenolphthalein endpoint with aqueous sodium hydroxide. After the water had been removed at reduced pressure, the residue was boiled with 300 ml of ethanol, cooled to 5° C. and filtered; the cake was washed several times with cold ethanol. The combined ethanol solutions were then evaporated to leave 254.4 g of viscous, orange-red oil, which was dissolved in 1400 ml of acetone diluted with 300 ml of diethyl ether and chilled at −15° C. for several days. The supernatant was decanted and evaporated; the orange viscous oil was heated at 90° C. and 1–2 mm to remove the ethylene glycol formed by the hydrolysis of the chlorohydrin; 227.1 g (89%).

Anal: Calcd. for $C_{10}H_{18}N_8O_3$: N, 37.57; Cl, 0.00. Found: N, 36.11; Cl, 0.43.

A water-white viscous oil can be obtained by boiling some of the above product with ethyl acetate, cooling to ambient, decanting the supernatant and evaporating the latter.

Anal: Found: N, 36.94.

The solid gas generating propellant compositions according to the present invention are useful in gun propellant applications and as gas generators. As gas generator examples, they are useful for the propulsion and guidance of gas escape reaction propelled devices, such as rockets and for gas pressure operated mechanical devices, such as, engines, turbines, pneumatic tools and generators.

What is claimed is:

1. A gas generant propellant containing:

A. a mixture of (1) polyethylene capped polypropylene glycol and a dihydroxy tetrazole selected from the group having the formulas:

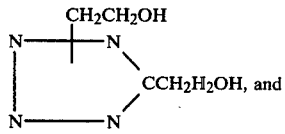

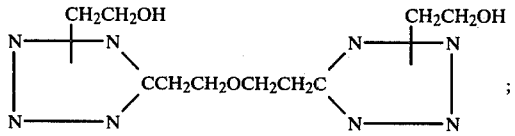

which has been cured by means of a diisocyanate;

B. a plasticizer; and

C. a deflagrating agent selected from the group consisting of:

dihydrazinium 3,6-bis(5-tetrazolyl)-1,2-dihydrotetrazine, dinitrosopentamethylenetetramine, the reaction product of glyoxal and hydrazine and the ammonium salt of 5-nitramino tetrazole.

2. A gas generant propellant according to claim 1 which contains, in addition to the components set forth in claim 1, an oxamide coolant agent.

3. A gas generant composition according to claim 2 wherein said diisocyanate is the biuret trimer of hexamethylene diisocyanate.

4. A gas generant composition according to claim 3 wherein the deflagrating agent is the ammonium salt of 5-nitramino tetrazole.

5. A gas generant composition according to claim 4 wherein the plasticizer is 1-methyl-5-(methoxyethyl)tetrazole.

6. A gas generant propellant according to claim 5 which contains 2.06 wt. % of said dihydroxyethyl tetrazole, 10.62 wt. % of said glycol, 7.32 wt. % of said plasticizer, 25.00 wt. % of said deflagrating agent and 35.00 wt. % of said oxamide coolant agent.

7. A gas generant propellant according to claim 5 which contains 2.58 wt. % of said dihydroxyethyl tetrazole, 13.27 wt. % of said glycol, 9.15 wt. % of said diisocyanate, 25.00 wt. % of said plasticizer, 20.00 wt. % of said deflagrating agent and 30.00 wt. % of said oxamide coolant agent.

* * * * *